US012740603B2

(12) United States Patent
Goff

(10) Patent No.: US 12,740,603 B2
(45) **Date of Patent: *Sep. 22, 2026**

(54) POCKET BRA SYSTEM

(71) Applicant: SherryWear, LLC, Vero Beach, FL (US)

(72) Inventor: Sharon Goff, Vero Beach, FL (US)

(73) Assignee: SherryWear, LLC, Vero Beach, FL (US)

( * ) Notice: Subject to any disclaimer, the term of this patent is extended or adjusted under 35 U.S.C. 154(b) by 276 days.

This patent is subject to a terminal disclaimer.

(21) Appl. No.: 18/223,363

(22) Filed: Jul. 18, 2023

(65) Prior Publication Data

US 2023/0363465 A1 Nov. 16, 2023

Related U.S. Application Data

(63) Continuation of application No. 17/319,482, filed on May 13, 2021, which is a continuation of application No. 16/260,217, filed on Jan. 29, 2019, now Pat. No. 11,051,561, which is a continuation of application No. 15/679,206, filed on Aug. 17, 2017, now Pat. No. 10,219,550, which is a continuation of application No. 15/045,606, filed on Feb. 17, 2016, now Pat. No. 9,808,036, which is a continuation-in-part of application No. 14/082,777, filed on Nov. 18, 2013, now Pat. No. 9,295,288, which is a continuation-in-part of application No. 13/066,822, filed on Apr. 26, 2011, now Pat. No. 8,597,072.

(51) Int. Cl.
*A41C 3/00* (2006.01)
*A41D 27/20* (2006.01)

(52) U.S. Cl.
CPC ..... *A41C 3/0035* (2013.01); *A41D 27/205* (2013.01)

(58) Field of Classification Search
CPC ..... A41C 3/0035
USPC ..... 450/89
See application file for complete search history.

(56) References Cited

U.S. PATENT DOCUMENTS

| | | | | |
|---|---|---|---|---|
| 2,624,881 | A * | 1/1953 | Dunson | A41C 3/0035 224/648 |
| 3,747,545 | A | 7/1973 | Nicolay et al. | |
| 4,263,678 | A | 4/1981 | Off | |
| 4,699,144 | A | 10/1987 | Sherwood | |
| 5,334,082 | A | 8/1994 | Barker | |
| 5,395,280 | A | 3/1995 | Greenberg | |
| 5,496,205 | A | 3/1996 | Lee | |
| 5,630,229 | A * | 5/1997 | Machado | A41D 13/012 2/2.15 |

(Continued)

*Primary Examiner* — Gloria M Hale
(74) *Attorney, Agent, or Firm* — CALDWELL LLC

(57) ABSTRACT

A pocket bra including a strap assembly, the strap assembly including a chest strap, two shoulder straps, a left cup, and a right cup. Each of the left and right cups define an area to receive a breast of a wearer and further include an inside surface and an outside surface. The strap assembly is attached to the left cup and the right cup, whereby the strap assembly is operable to connect the left cup and the right cup to the wearer. A pocket is formed on each of the two shoulder straps, each pocket including an opening capable of repeated receiving and removal of an item when being worn by the wearer. The pockets are positioned on inside surfaces of the shoulder straps such that they face the wearer when the pocket bra is worn.

16 Claims, 6 Drawing Sheets

(56) References Cited

U.S. PATENT DOCUMENTS

| | | | | |
|---|---|---|---|---|
| 5,799,336 | A | 9/1998 | Cooper | |
| 7,234,996 | B1 * | 6/2007 | Donker | A41C 3/0035 450/1 |
| 7,585,200 | B1 | 9/2009 | Mclaren | |
| 7,753,759 | B2 | 7/2010 | Pintor et al. | |
| 8,257,140 | B2 | 9/2012 | Kenny | |
| 8,484,763 | B1 | 7/2013 | Lucas | |
| 8,597,072 | B1 | 12/2013 | Lucas | |
| 9,289,016 | B1 | 3/2016 | Goff | |
| 9,295,288 | B1 | 3/2016 | Goff | |
| 9,486,019 | B2 * | 11/2016 | Kitowski | A41D 13/005 |
| 9,661,879 | B1 * | 5/2017 | Gurr | A41D 27/205 |
| 9,723,878 | B1 | 8/2017 | Goff | |
| 9,808,036 | B1 | 11/2017 | Goff | |
| 10,219,550 | B1 | 3/2019 | Goff | |
| 10,219,551 | B1 | 3/2019 | Goff | |
| 10,869,510 | B1 | 12/2020 | Goff | |
| 11,051,561 | B1 * | 7/2021 | Goff | A41C 3/0035 |
| 11,771,145 | B1 * | 10/2023 | Goff | A41C 3/0035 450/89 |
| 2004/0111782 | A1 * | 6/2004 | Lenormand | A41D 13/05 2/69 |
| 2008/0032600 | A1 | 2/2008 | Updyke | |
| 2009/0104845 | A1 | 4/2009 | Pintor et al. | |
| 2009/0209173 | A1 * | 8/2009 | Arledge | A41C 3/0057 450/86 |
| 2010/0124869 | A1 | 5/2010 | Liu | |
| 2010/0298914 | A1 * | 11/2010 | Rosenbaum | A61F 7/00 450/86 |
| 2011/0275278 | A1 * | 11/2011 | Shashy | A41C 3/0057 450/86 |

* cited by examiner

FIG. 4
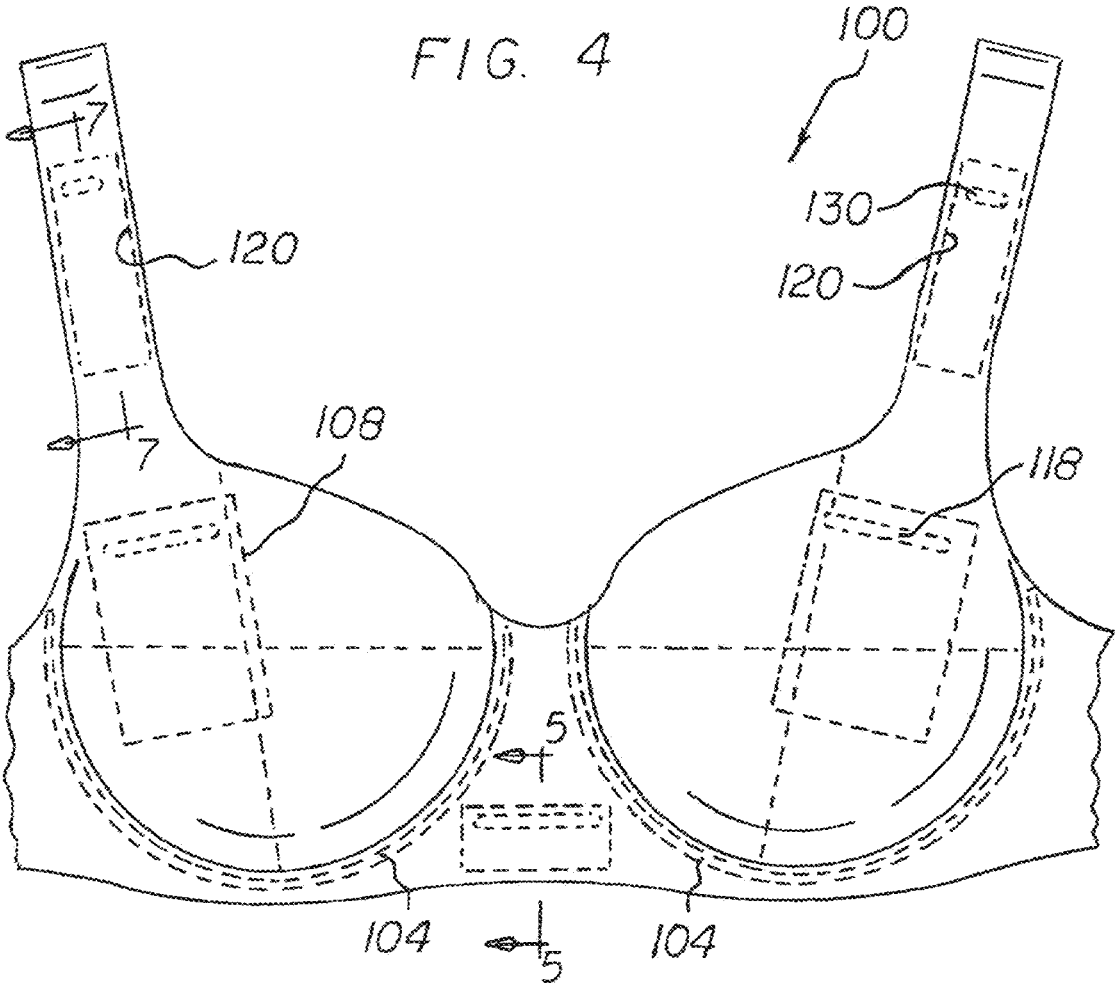
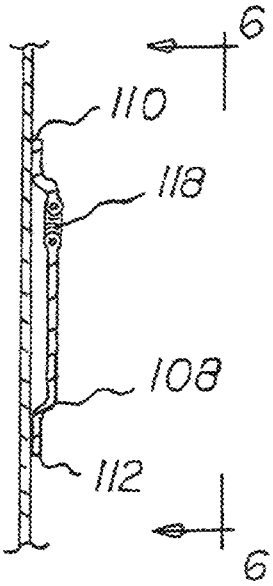
FIG. 5
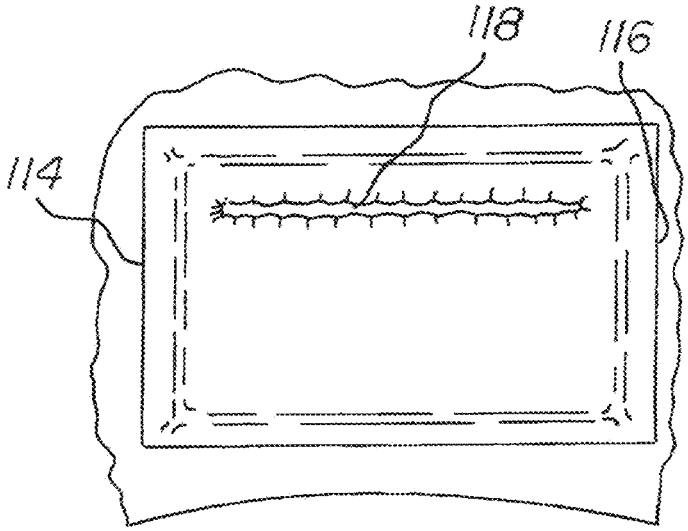
FIG. 6

POCKET BRA SYSTEM

CROSS-REFERENCE TO RELATED APPLICATIONS

This application is a continuation of Non-provisional application Ser. No. 17/319,482, filed on May 13, 2021, and entitled "POCKET BRA SYSTEM", which is a continuation of Non-provisional application Ser. No. 16/260,217, filed on Jan. 29, 2019, and entitled "POCKET BRA SYSTEM", which is a continuation of Non-provisional application Ser. No. 15/679,206, filed on Aug. 17, 2017, and entitled "POCKET BRA SYSTEM", which is a continuation of Non-provisional application Ser. No. 15/045,606, filed on Feb. 17, 2016, and entitled "POCKET BRA SYSTEM", which is a continuation-in-part of Non-provisional application Ser. No. 14/082,777, filed on Nov. 18, 2013, and entitled "POCKET BRA SYSTEM", which is a continuation-in-part of Non-provisional application Ser. No. 13/066,822, filed on Apr. 26, 2011, and entitled "POCKET BRA SYSTEM", all of which are incorporated herein by reference in their entirety.

FIELD OF THE INVENTION

The present invention relates to a pocket bra system and more particularly pertains to removably receiving a hand-held electronic device while providing support and shape to the breasts of a wearer, the receiving, supporting, and shaping being done in a safe, convenient, and economical manner.

BACKGROUND

Bras are generally designed solely to support the breasts of a wearer. As such, when women are engaged in an activity in which their top dress consists only of a bra—such as various forms of physical exercise—they have been forced to store their items in articles such as an arm band. Such a storage system requires women to implement yet another piece of equipment into their workout routine. Implementing an additional article can be expensive and can add bulk.

SUMMARY OF THE DISCLOSURE

In an aspect, a pocket bra including a strap assembly, the strap assembly including a chest strap, two shoulder straps, a left cup, and a right cup. Each of the left and right cups define an area to receive a breast of a wearer and further include an inside surface and an outside surface. The strap assembly is attached to the left cup and the right cup, whereby the strap assembly is operable to connect the left cup and the right cup to the wearer. A pocket is formed on each of the two shoulder straps, each pocket including an opening capable of repeated receiving and removal of an item when being worn by the wearer. The pockets are positioned on inside surfaces of the shoulder straps such that they face the wearer when the pocket bra is worn.

In another aspect, a pocket bra including a strap assembly, the strap assembly including a chest strap, two shoulder straps, a left cup, and a right cup. Rach of the left and right cups define an area to receive a breast of a wearer and further include an inside surface and an outside surface. The strap assembly is attached to the left and right cup, whereby the strap assembly is operable to connect the left and right cup to the wearer. A pocket is formed on each of the two shoulder straps, each pocket including non-sealing openings capable of repeated receiving and removal of an item when being worn by the wearer. The pockets are formed by layers of the two shoulder straps. The layers comprise linear slits, wherein the linear slits form an opening to each pocket.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein:

FIG. 4 is a front elevational view of a pocket bra system constructed in accordance with an alternate embodiment of the invention;

FIG. 5 is a cross sectional view taken along line 5-5 of FIG. 4;

FIG. 6 is a rear elevational view taken along line 6-6 of FIG. 5;

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

Figure 1:
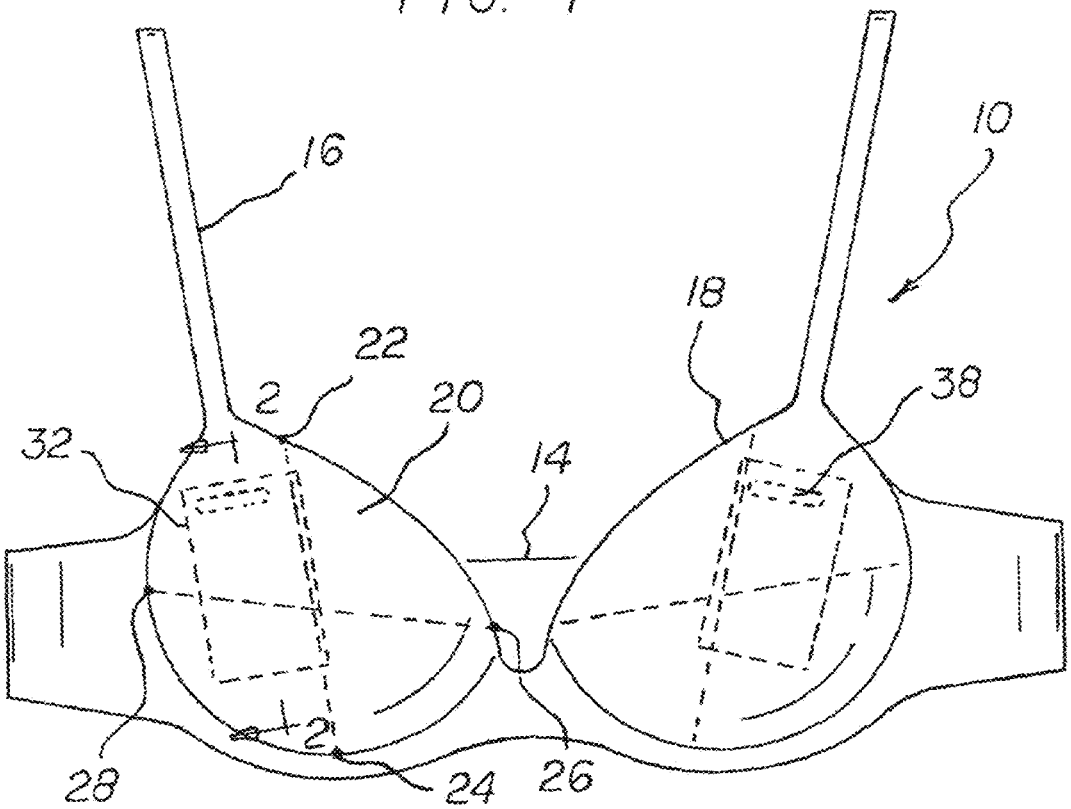
FIG. 1 is a front elevational view of a pocket bra system constructed in accordance with the principles of the present invention.
Figure 2:
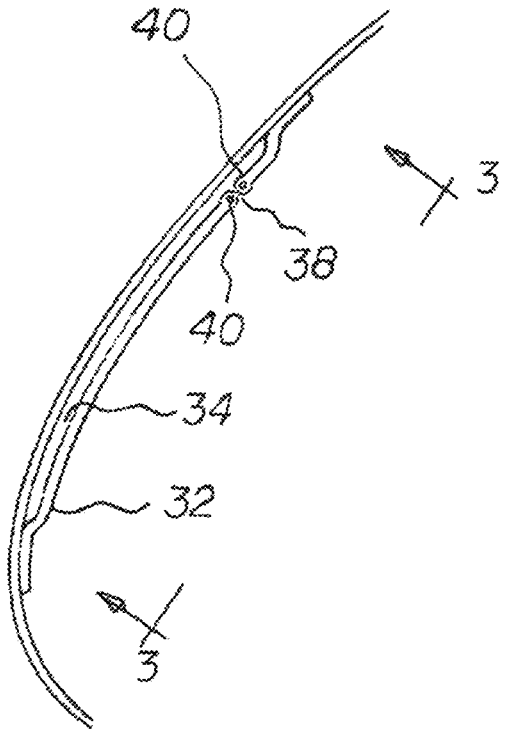
FIG. 2 is a cross sectional view taken along line 2-2 of FIG. 1.
Figure 3:
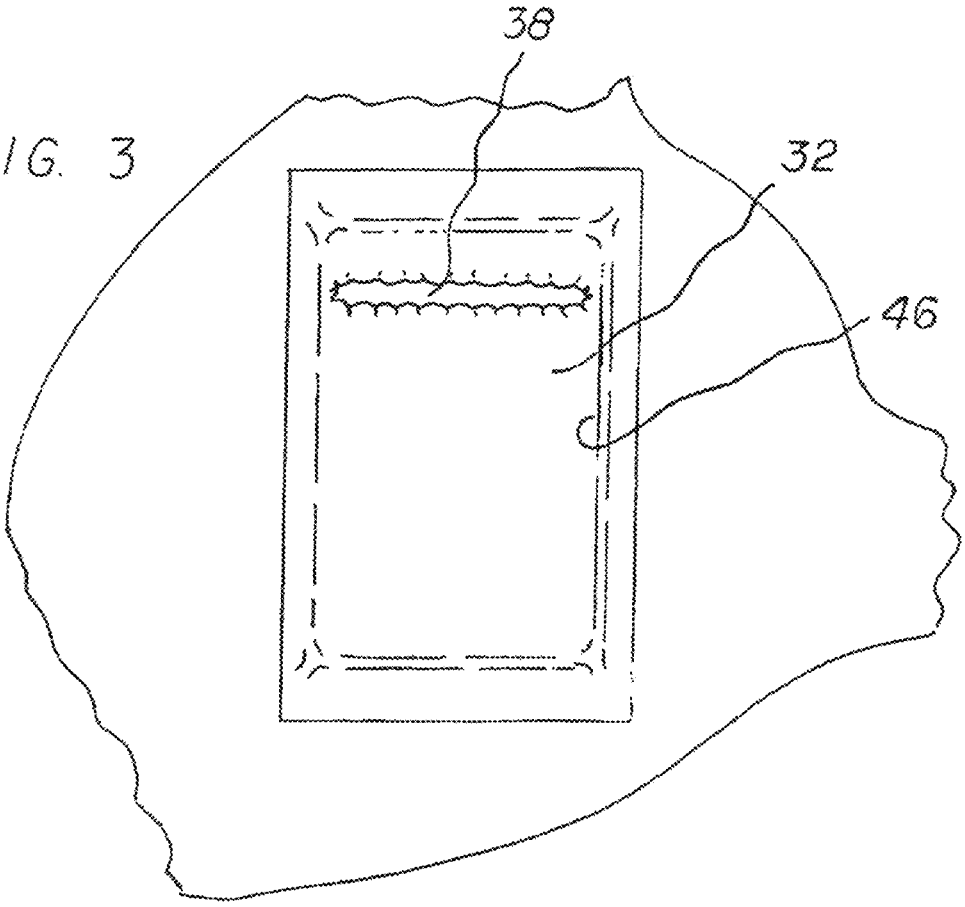
FIG. 3 is a rear elevational view taken along line 3-3 of FIG. 2.
Figure 7:
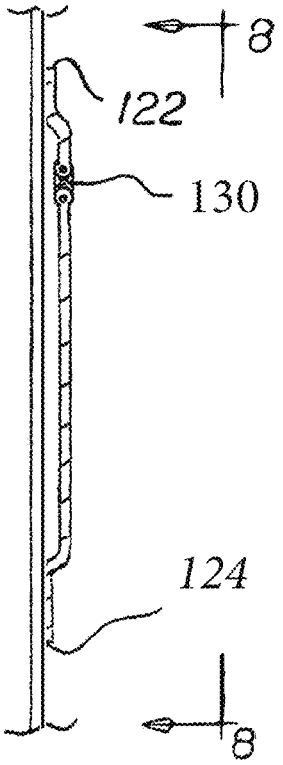
FIG. 7 is a cross sectional view taken along line 7-7 of FIG. 4.
Figure 8:
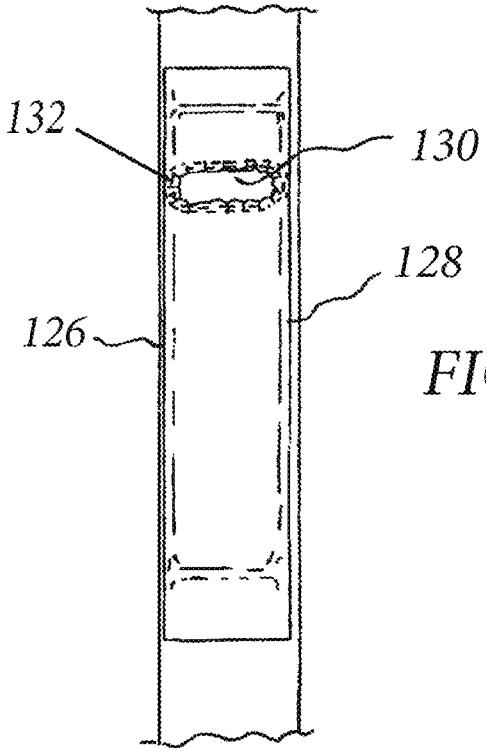
FIG. 8 is a rear elevational view taken along line 8-8 of FIG. 7.

With reference now to the drawings, and in particular to FIG. 1 thereof, the preferred embodiment of the new and improved pocket bra system embodying the principles and concepts of the present invention and generally designated by the reference numeral 10 will be described.

The present invention, the pocket bra system 10 is comprised of a plurality of components. Such components in their broadest context include a strap, left and right cups, a rectangular patch and a linear slit. Such components are individually configured and correlated with respect to each other so as to attain the desired objective.

First provided is a strap assembly. The strap assembly includes a generally horizontal chest strap 14. The chest strap is positionable around the chest and back of a wearer. The strap assembly includes left and right generally vertical shoulder straps 16. The shoulder straps are positionable over the shoulders of the wearer. The shoulder straps have free ends. The free ends are coupled to the chest strap adjacent to the chest of the wearer and adjacent to the back of the wearer.

A left cup 18 is provided. A similarly configured right cup 20 is provided. Each cup has an inside surface and an outside surface. The left and right cups each have an upper-most point 22. The left and right cups each have a lower-most point 24. A generally vertical axis is provided. The vertical axis divides each cup into an inner hemisphere interiorly and an outer hemisphere exteriorly. The left and right cups each have an inner-most point 26. The left and right cups each have an outer-most point 28. A generally horizontal axis is provided. The horizontal axis divides each cup into an upper hemisphere above and a lower hemisphere below.

A rectangular patch 32 is provided next. The patch is operatively associated with each cup. Each patch has generally horizontal upper and lower edges. Each patch has generally vertical interior and exterior edges. The patch has a periphery. The periphery has stitching. In this manner the periphery of each patch is coupled to the inside surface of an associated cup. The majority of each patch is in the upper hemisphere. The majority of each patch is in the outer hemisphere. A rectangular chamber 34 is provided. The chamber is provided between each patch and its associated cup. The chamber is rectangular. The chamber has a height of 120 and 140 millimeters. The chamber has a width of between 60 and 70 millimeters. The pockets are fabricated of a resilient closed cell polyurethane foam. The foam has a thickness of from 2 to 4 millimeters. The patches are fabricated of an elastic fabric.

Further provided is a linear slit 38. The slit is provided in each patch. The slit is provided parallel with, and closely spaced from, the upper edge of each patch. Each slit has a length greater than 90 percent of the width of the chamber. An elastic band 40 is provided. The elastic band is provided within each patch. The elastic band surrounds the slit. The elastic band is adapted to return the slit to a closed orientation. The elastic band is further adapted to allow the slit to stretch to an enlarged orientation.

Provided last is a handheld electronic device 46. The handheld electronic device is positionable within the chamber. The handheld electronic device has a height of 115 millimeters, plus or minus 10 percent. The handheld electronic device has a width of 59 millimeters. The handheld electronic device has a thickness of 9 millimeters plus or minus 10 percent. The slit is adapted to stretch to the open orientation when adding the handheld device to, or removing the handheld device from, the chamber. The slit is adapted to contract to the closed orientation when the handheld device is within or without the chamber. The thickness and the material of the cups and the patches are adapted to abate inward projections by the handheld devices in the chambers tending to poke a user. The thickness and the material of the cups and the patches are adapted to abate outward projections by the handheld devices in the chambers tending to create unsightly projections.

An alternate embodiment 100 of the present invention is provided. An under-wire 104 is provided. The under-wire is provided beneath each cup.

A central patch 108 is provided. The central patch is provided intermediate the cups. In this manner a central chamber is formed. The central patch has horizontal upper and lower edges 110, 112. The central patch has vertical side edges 114, 116. The upper and lower edges are longer than the side edges. The central patch has a central slit 118. The central slit is provided parallel with and in proximity to the upper edge. The central chamber is adapted to receive and support keys.

An upper patch 120 is provided on each shoulder strap. The upper patches have horizontal upper and lower edges 122, 124. The upper patches have vertical side edges 126, 128. The upper and lower edges are shorter than the side edges. The upper patches each have an upper slit 130 surrounded by an elastic band 132. The upper slit is provided parallel with and in proximity to the upper edge. The upper chambers are adapted to receive and support pills.

FIGS. 9 through 12 illustrate a system 200 constructed in accordance with another alternate embodiment of the invention. In such alternate embodiment, enlarged bra pockets 202 are constructed on the cups of the bra. In addition, side pockets 204 are constructed along both sides of the bra. Although only a right side pocket is illustrated, it should be understood that a similarly constructed left side pocket is preferably provided additionally.

Figure 9:
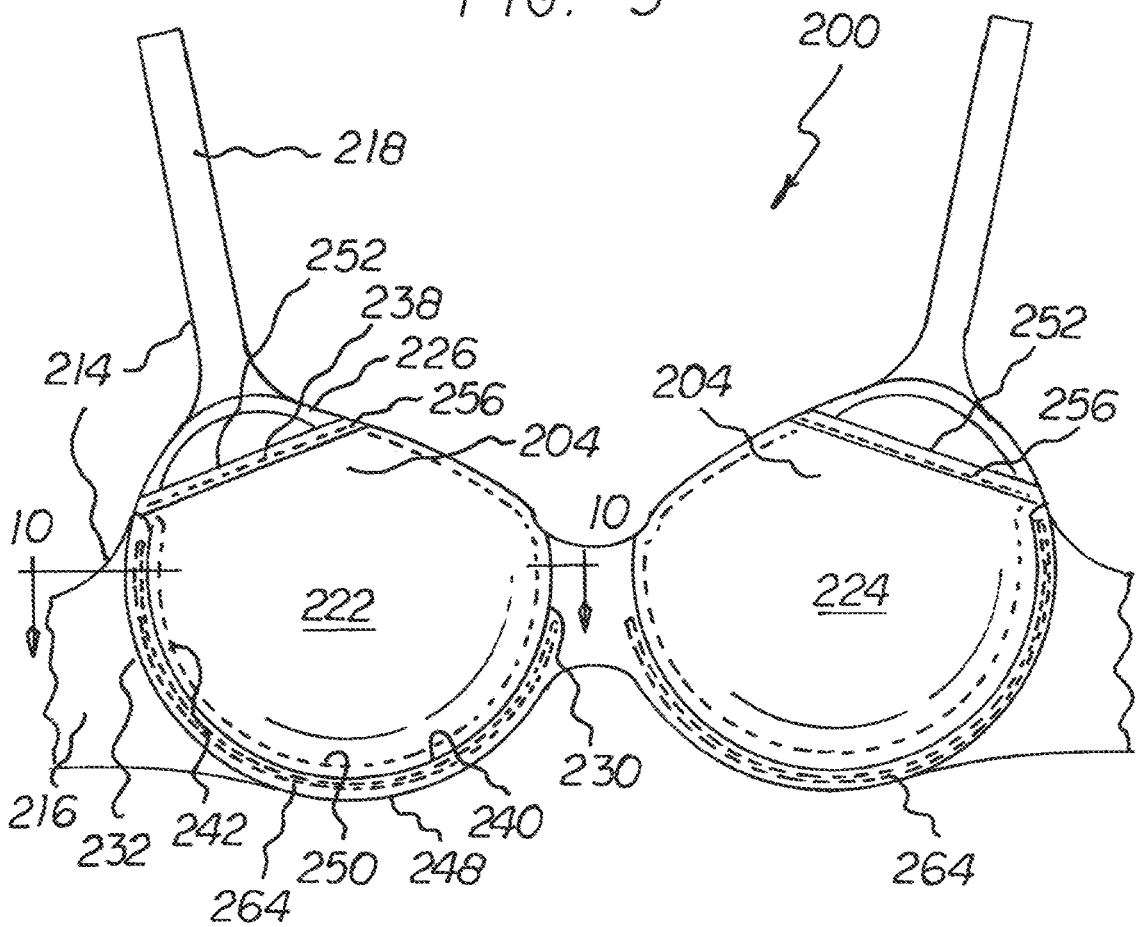
FIG. 9 is a front elevational view of a pocket bra system constructed in accordance with another alternate embodiment of the invention.
Figure 10:
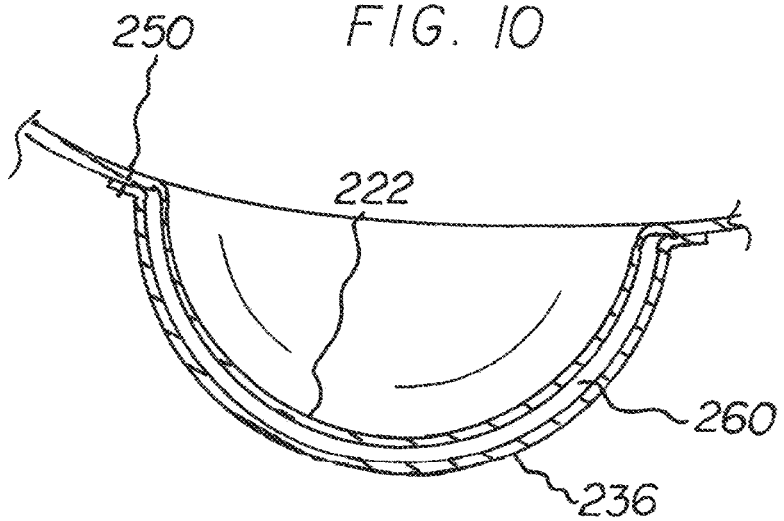
FIG. 10 is a cross sectional view taken along line 10-10 of FIG. 9.
Figure 11:
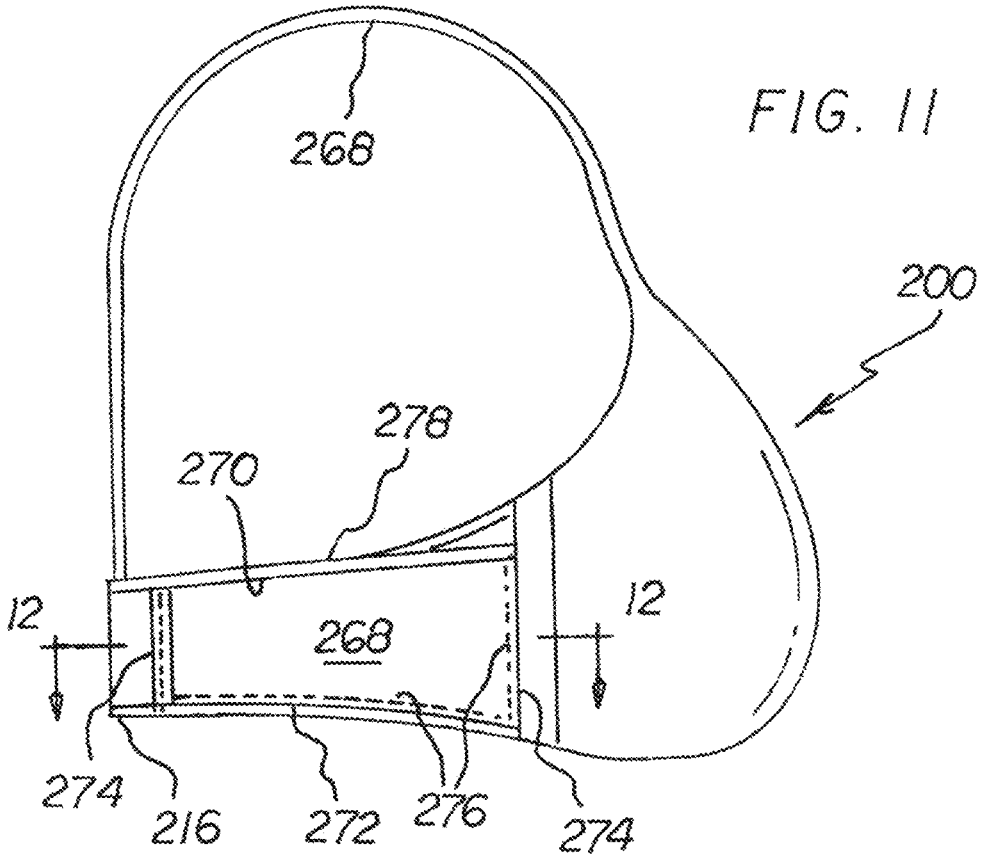
FIG. 11 is a side elevational view of the pocket bra system shown in FIGS. 9 and 10.
Figure 12:
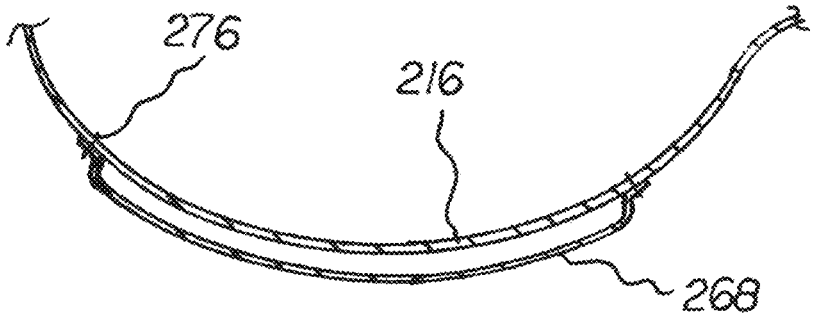
FIG. 12 is a cross sectional view taken along line 12-12 of FIG. 11.

As shown in FIGS. 9 and 10, there is illustrated a pocket bra system 200 for removably receiving a handheld electronic device and other objects while providing support and shape to the breasts of a wearer. The system includes a strap assembly 214. The strap assembly is formed of a chest strap 216 and shoulder straps 218.

Next provided are similarly configured left and right cups 222, 224. Each cup has inside and outside surfaces. The strap assembly is attached to the cups whereby the strap assembly adheres the cups to a wearer. Each cup has curved upper edge 226, a lower edge 228, an interior edge 230 and an exterior edge 232. Each cup has inside and outside surfaces.

A patch 236 is operatively associated with each cup. Each patch has a linear upper edge 238 and a curved lower edge 240, an interior edge 242 and an exterior edge 248. Each patch has inside and outside surfaces.

Stitching 250 couples the lower, interior and exterior edges of each patch to the lower, interior and exterior edges of an associated cup. A linear opening 252 is thus formed along the upper edge of each patch. Piping 256 covers the upper edge of each patch. The upper edge of the patch and the piping are adapted to allow the patch to move away from and back toward the cup between open and closed orientations.

Pockets 260 are formed between the patches and the cups. The cups are preferably fabricated of a resilient closed cell polyurethane foam with a thickness of from 2 to 4 millimeters. The patches are also preferably fabricated of a resilient closed cell polyurethane foam with a thickness of from 2 to 4 millimeters.

A handheld electronic device 46 is adapted to be placed within a pocket.

An under-wire 264 is coupled beneath each cup in a generally vertical plane.

Lastly provided is a side patch 268 on each side of the chest strap. The side patches each have a horizontal upper edge 270 and a lower edge 272 and vertical side edges 274. The upper and lower edges of each patch are longer than the side edges. The side patches include side stitching 276 along the lower and side edges. Thus is formed an upper opening 278 at each side patch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pocket bra comprising:

a strap assembly comprising a chest strap, two shoulder straps, a left cup, and a right cup, wherein:

each of the left and right cups define an area to receive a breast of a wearer, and further comprise an inside surface and an outside surface, wherein each of the left and right cups further comprises a rectangular patch first pocket positioned on the inside surface;

the strap assembly being attached to the left cup and the right cup, whereby the strap assembly is operable to connect the left cup and the right cup to the wearer;

a second pocket on each of the two shoulder straps, each second pocket comprising an opening defined by a slit having an elastic band surrounding the slit, wherein the elastic band surrounded slit is configured to be stretched open by the wearer to thereby allow an item to be placed into and removed from said second pocket, and to then release said elastic to return the opening to a closed position when released by the wearer when the pocket bra is worn by the wearer; and wherein the pockets are positioned on an inside surface of the shoulder straps such that they are facing and adjacent to a skin surface of the wearer when the pocket bra is worn.

2. The pocket bra of claim 1, wherein the second pocket is formed by a shoulder strap layer attached to one of the two shoulder straps.

3. The pocket bra of claim 2, wherein the shoulder strap layer is attached to one of the two shoulder straps by a stitching.

4. The pocket bra of claim 1, wherein the second pocket is fabricated of a resilient closed cell polyurethane foam with a thickness of from 2 to 4 millimeters.

5. The pocket bra of claim 2, wherein an upper edge of the shoulder strap layer crosses over a surface of the cup to form the opening.

6. The pocket bra of claim 5, further comprising a central patch with a central slit provided in parallel with and in proximity to the upper edge.

7. The pocket bra of claim 1, further comprising sides on the bra's chest strap and a plurality of additional pockets on a plurality of sides comprising a left side bra strap and a right side bra strap of the chest strap.

8. The pocket bra of claim 1, wherein a sealing device is attached to the opening.

9. The pocket bra of claim 1, wherein the rectangular first pocket is disposed on a side panel of the pocket bra and comprises an opening sized to receive a handheld electronic device.

10. A pocket bra comprising:

a strap assembly comprising a chest strap, two shoulder straps, a left cup, and a right cup, wherein:

each of the left and right cups define an area to receive a breast of a wearer, and further comprise an inside surface and an outside surface, wherein each of the left and right cups further comprises a rectangular first pocket positioned on the inside surface;

the strap assembly being attached to the left and right cup, whereby the strap assembly is operable to connect the left and right cup to the wearer, a second pocket on each of the two shoulder straps, each second pocket comprising non-sealing openings capable of repeated receiving and removal of an item when being worn by the wearer; and wherein the first and second pockets are formed by layers of the two shoulder straps, the layers comprising linear slits, wherein the linear slits form an opening to the first and second pockets.

11. The pocket bra of claim 10, further comprising a central pocket intermediate to the left and right cups.

12. The pocket bra of claim 11, wherein the central pocket comprises a central slit provided parallel with and in proximity to an upper edge of the central pocket.

13. The pocket bra of claim 10, wherein the pocket is positioned on an inside surface of one of the two shoulder straps such that it is facing the wearer when the pocket bra is worn.

14. The pocket bra of claim 10, wherein the linear slit runs parallel to an upper edge of each pocket.

15. The pocket bra of claim 10, wherein the linear slit has a length that is greater than 90 percent of a width of the pocket.

16. The pocket bra of claim 10, further comprising sides on the bra's chest strap and a plurality of additional pockets on the sides of the chest strap.

* * * * *